US005261189A

United States Patent [19]

Chu

[11] Patent Number: 5,261,189

[45] Date of Patent: Nov. 16, 1993

[54] STRUCTURE OF WINDOW

[76] Inventor: Fu-Pong Chu, No. 3, Lane 41, Ho-Nan Rd., Kaohsiung City, Taiwan

[21] Appl. No.: 910,220

[22] Filed: Jul. 9, 1992

[51] Int. Cl.[5] ..... E05D 15/06; E06B 1/04

[52] U.S. Cl. ..... 49/404; 49/458; 49/406

[58] Field of Search ..... 49/404, 406, 409, 410, 49/411, 425, 428, 449, 458, 475, 485, 498; 52/206, 207

[56] References Cited

U.S. PATENT DOCUMENTS

| | | | |
|---|---|---|---|
| 3,106,753 | 10/1963 | Guldager | 49/406 |
| 3,600,857 | 8/1971 | La Barge | 49/404 |
| 4,064,653 | 12/1977 | Randall et al. | 49/458 |
| 4,398,373 | 8/1983 | Mancuso | 49/425 |
| 4,554,770 | 11/1985 | Anders | 49/425 X |
| 4,803,809 | 2/1989 | Takemura | 49/404 |
| 4,815,246 | 3/1989 | Haas | 49/404 X |
| 4,924,628 | 5/1990 | Ruby et al. | 49/404 X |

FOREIGN PATENT DOCUMENTS

| | | | |
|---|---|---|---|
| 81488 | 4/1991 | Japan | 52/206 |

*Primary Examiner*—Peter M. Cuomo
*Assistant Examiner*—Jerry Redman
*Attorney, Agent, or Firm*—Morton J. Rosenberg; David I. Klein

[57] ABSTRACT

A window structure includes a frame, two sliding panels and a locking element interlocking the sliding panels. The frame consists of two horizontal members, two vertical members and an upright middle pillar which interconnects the middle portions of the horizontal members. Each of the horizontal members has two parallel channels on two sides of the middle pillar, along which the sliding panels are slidable. Two endless slots are formed in the window structure on two sides of the middle pillar and are filled with two resilient primary sealing strips respectively so as to establish a liquid- and air-tight seal between the frame and the sliding panels. Two inclined guiding members are mounted in the frame so that the primary sealing strips are compressed gradually between the frame and the sliding panels when the sliding panels are moved from the middle pillar to the vertical members.

11 Claims, 8 Drawing Sheets

STRUCTURE OF WINDOW

BACKGROUND OF THE INVENTION

1. Field of the Invention

This invention relates to a window structure, more particularly to an effectively sealing window structure which is effective in sound insulating, dust protection, water proof, weather sealing, etc.

2. Description of the Related Art

Common window structures are aluminum extrusions. Two sliding panels are movable in such a window structure so as to open or close the window. Clearances occur between the sliding panels and between the frame and the sliding panels, resulting in air flow between the inside and outside of the window. Accordingly, the conventional window structure has difficulty in sound insulating, water proof, dust protection, maintaining room temperature, etc.

SUMMARY OF THE INVENTION

It is therefore the main object of this invention to provide an effectively sealing window structure which can prevent noise, water, air and dust from entrance into the room therethrough.

According to this invention, a window structure includes a frame, two sliding panels and a locking element interlocking the sliding panels. The frame consists of two horizontal members, two vertical members and a middle pillar which interconnects the middle portions of the horizontal members. Each of the horizontal members has two parallel channels on two sides of the middle pillar, along which the sliding panels are slidable. Two endless slots are formed in the window structure on two sides of the middle pillar and are filled with two resilient primary sealing strips respectively so as to establish a liquid- and air-tight seal between the frame and the sliding panels.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
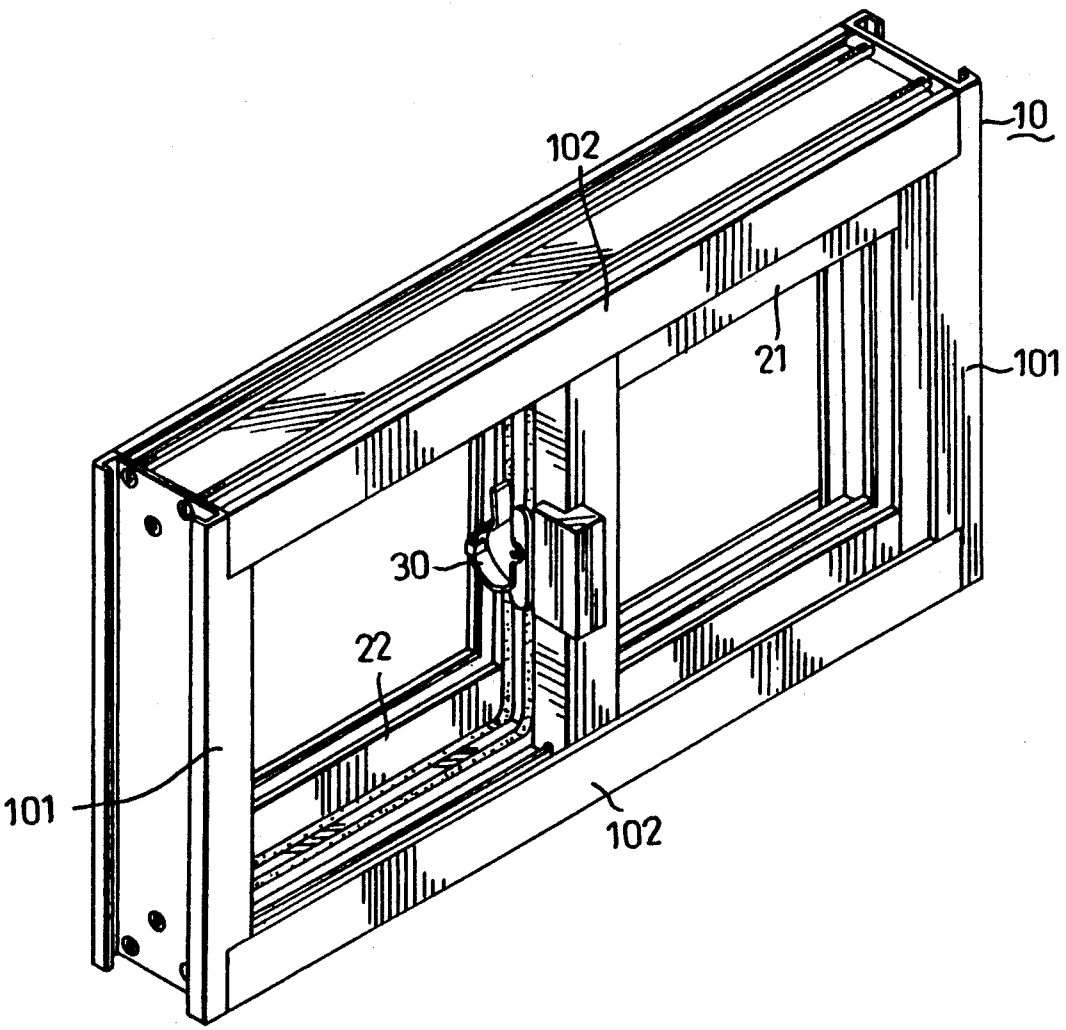
FIG. 1 is a perspective view of a window structure according to this invention.
Figure 2:
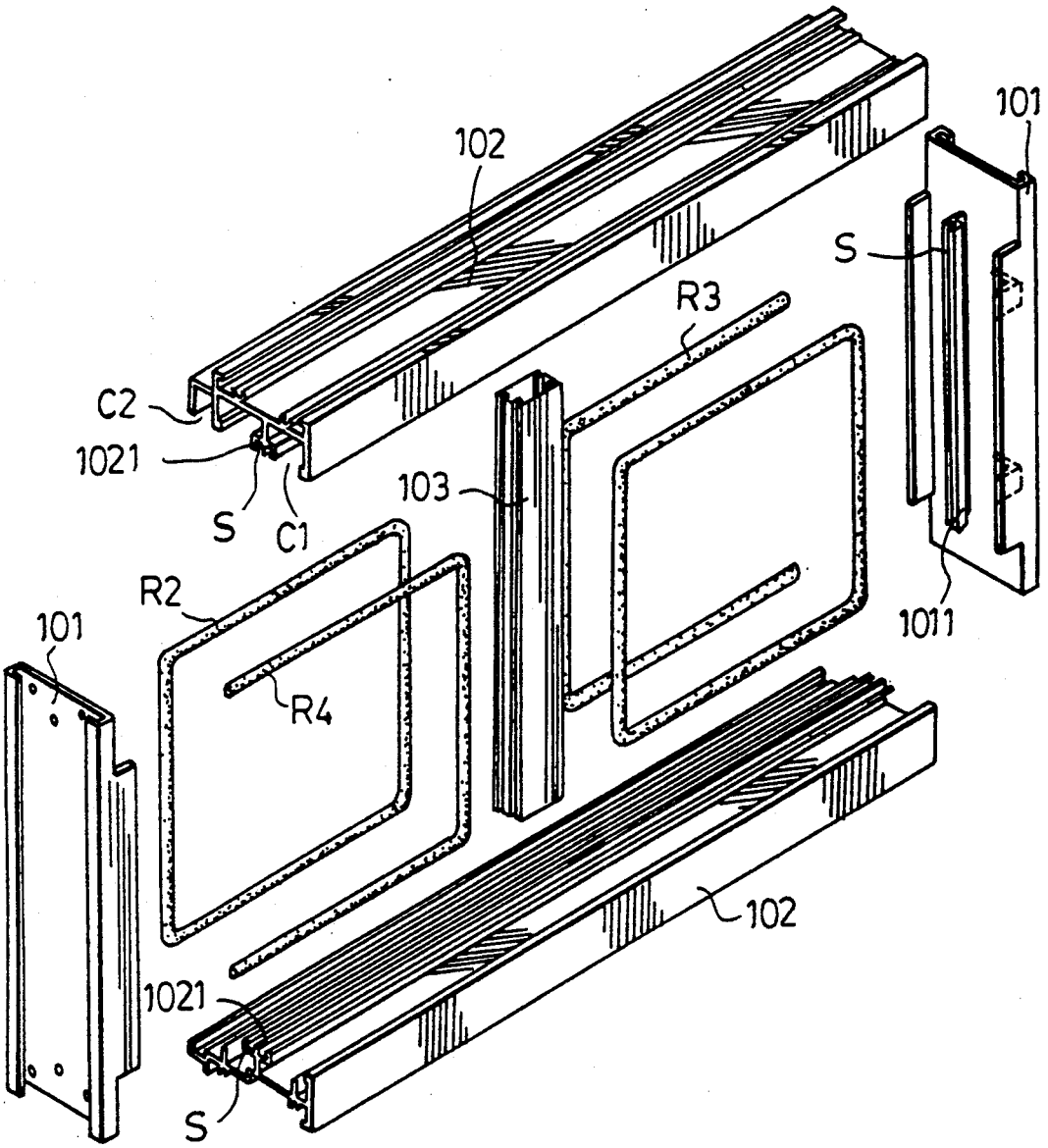
FIG. 2 is an exploded view showing the window structure of this invention.

Referring to FIGS. 1 and 2, a window structure of this invention includes a frame (10), an inner sliding panel (21), an outer sliding panel (22) and a locking element (30). The frame (10) consists of two vertical members (101), two horizontal members (102) and an upright middle pillar (103). Two vertical dividing ribs (1011) respectively project from the middle portions of the vertical members (101) in alignment with the middle pillar (103). Two horizontal dividing ribs (1021) respectively project from the middle portions of the horizontal members (102) in alignment with the middle pillar (103). The vertical dividing ribs (1011) extend toward each other and the horizontal dividing ribs (1021) extend toward each other so as to define two channels (C1, C2) for the sliding panels (21, 22) on two sides thereof. The middle pillar (103) has a generally rectangular cross-section and interconnects the middle portions of the horizontal members (102). In FIG. 1, the locking element (30) is located in a position where the inner and outer sliding panels (21, 22) are interlocked in the frame (10).

As best shown in FIG. 2, each of the vertical dividing ribs (1011) has a slot (S) formed along full length thereof. Each of the horizontal dividing ribs (1021) has two parallel slots (S) formed along full length thereof. Each of the side surfaces of the middle pillar (30) also has two slots (S) formed along two sides thereof. As illustrated, the slots (S) of the vertical dividing ribs (1011), the horizontal dividing ribs (1021) and two opposite side surfaces of the middle pillar (103) constitute together an endless inner slot, an endless outer slot, a U-shaped inner slot and a U-shaped outer slot. Each of the endless inner and outer slot consists of two horizontal sections and two vertical sections. Each of the U-shaped inner and outer slots consists of two horizontal sections and one vertical section. The endless inner and outer slots are adjacent to the inner and outer channels (C1, C2) respectively and are formed on two sides of the middle pillar (103). As illustrated, the endless inner slot is adjacent to the inward surface of the middle pillar (103), while the endless outer slot is adjacent to the outward surface of the middle pillar (103). Each of the endless inner and outer slots extend along a rectangular path in a plane and is filled with a resilient primary sealing strip (R1, R2). The primary sealing strips (R1, R2) is preferably made of rubber. Each of the U-shaped inner and outer slots extend along a U-shaped path in a plane and is filled with a resilient auxiliary sealing strip (R3, R4).

Figure 3:
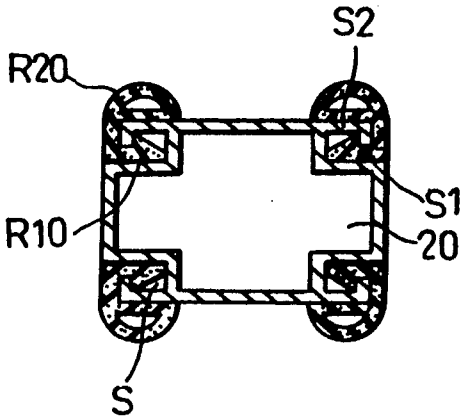
FIG. 3 is a schematic view illustrating the engagement of the resilient primary sealing strips within the slots of the middle pillar of the window structure according to this invention.

Referring to FIG. 3, the cross-section of each of the slots (S) has an opening (S1), and a restricting portion (S2) which is wider than the opening (S1). Each of the inner and outer primary sealing strips (R1, R2) has a generally U-shaped cross-section which includes an insertion element (R10) inserted into the restriction portion (S2) of the slot (S), and a hollow compressible element (R20) positioned between the sliding panel (21, 22) and the frame (10). The ends (R30) of each inner or outer primary sealing strips (R1, R2) abut against each other so that the inner and outer primary sealing strips (R1, R2) are shaped in the form of a rectangular frame which conforms to the shape of the endless inner and outer slots.

Figure 4:
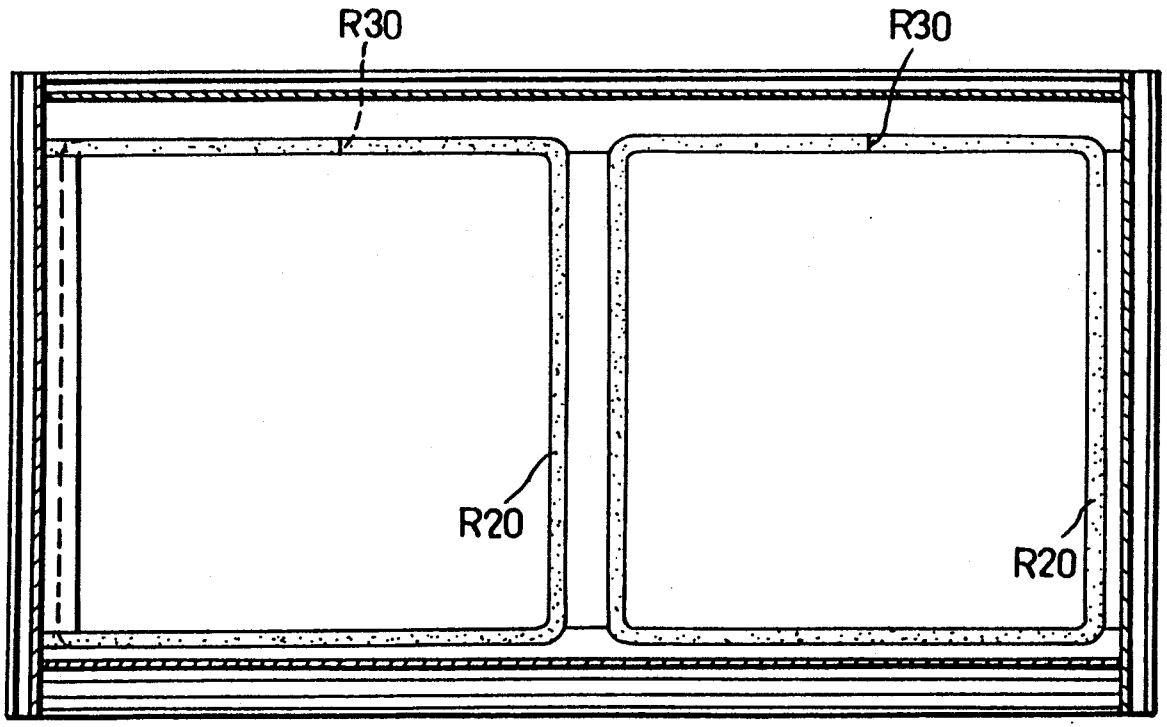
FIG. 4 is a schematic view illustrating the positions of the primary sealing strips in the window structure according to this invention.
Figure 5:
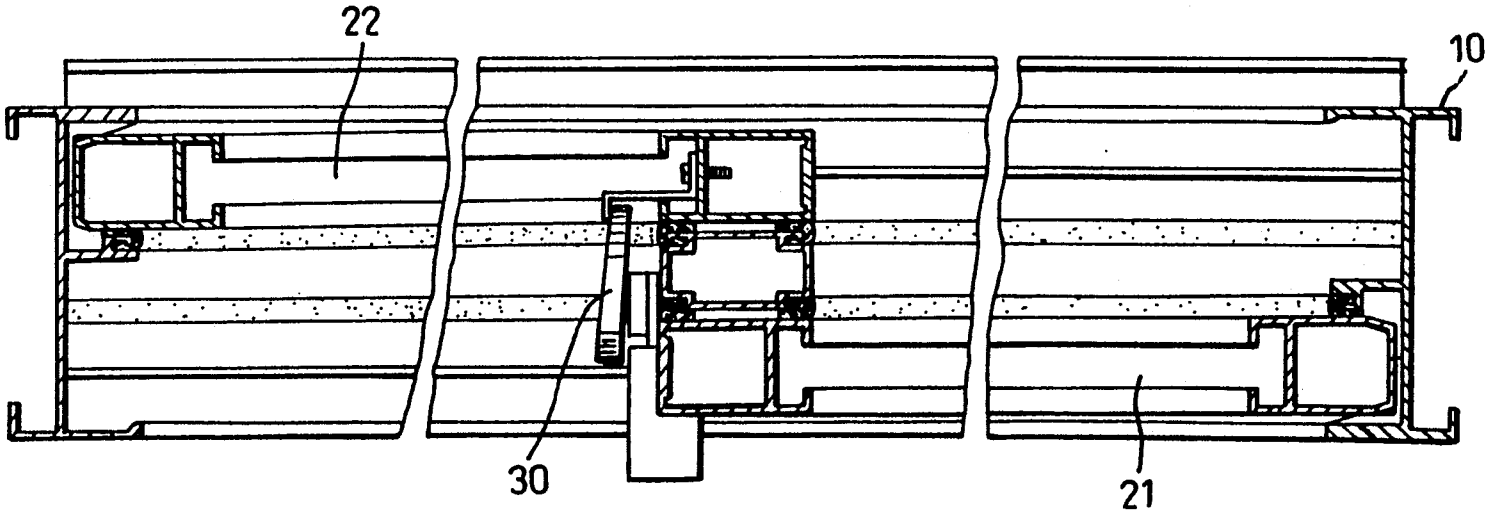
FIG. 5 is a schematic view illustrating the guiding members of the window structure according to this invention.

As shown in FIGS. 3 and 4, each of the compressible elements (R20) is exposed to the outsides of the slots (S)

and has a curved convex surface which contacts one of the sliding panels (21, 22). When the sliding panels (21, 22) are in the closed positions, the compressible elements (R20) are compressed between the frame (10) and the sliding panels (21, 22) so as to minimize flow of liquid and air therebetween.

In this embodiment, because each of the insertion elements (R10) has a truncately tapered head which is generally arrow-shaped, the insertion elements (R10) can be easily inserted into the slots (S).

Figure 7:
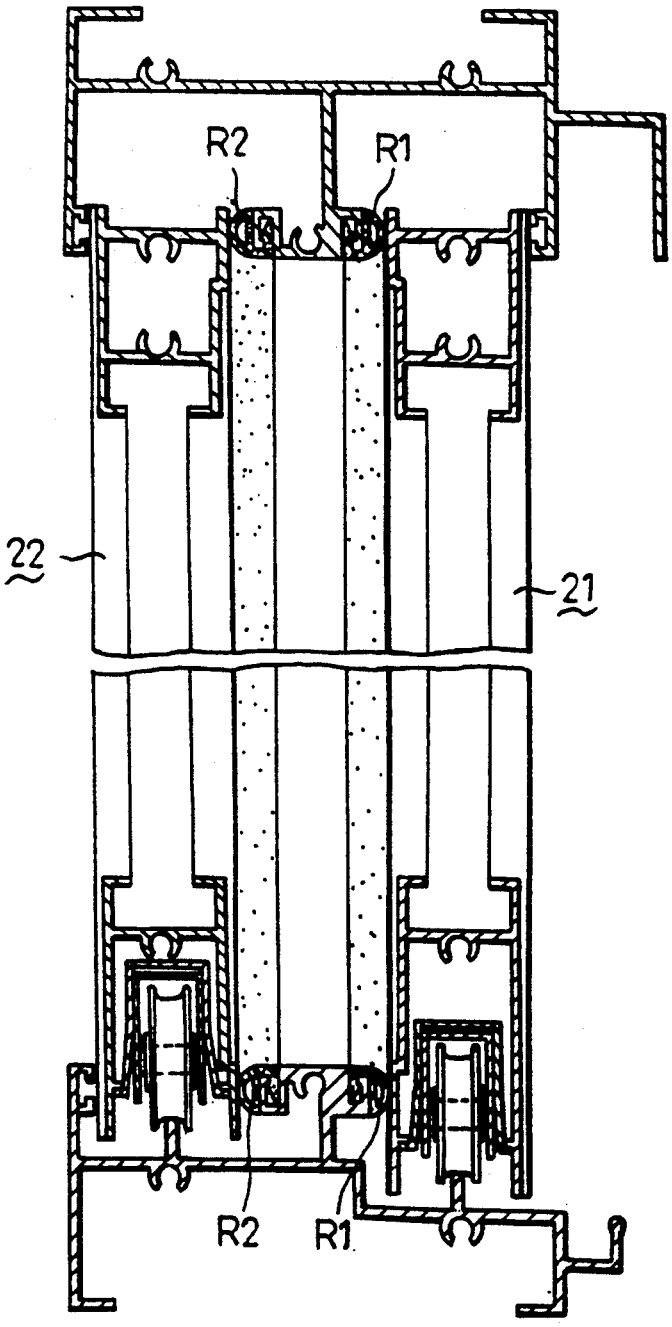
FIGS. 7 and 8 are schematic views illustrating how to compress the resilient primary sealing strips of the window structure in accordance with this invention.
Figure 8:
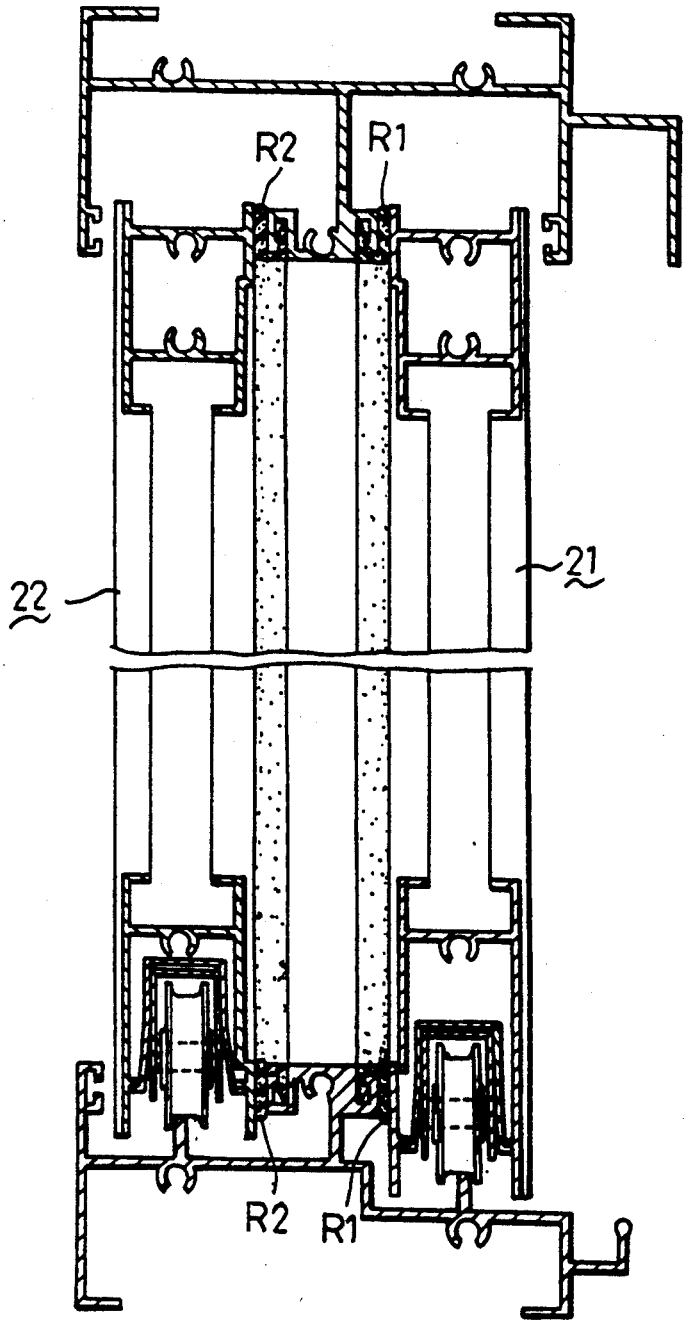

Referring to FIGS. 7 and 8, when the inner and outer sliding panels (21, 22) are moved from the open positions to the closed positions, the compressible elements (R20) are compressed gradually between the frame (10) and the sliding panels (21, 22).

Figure 6:
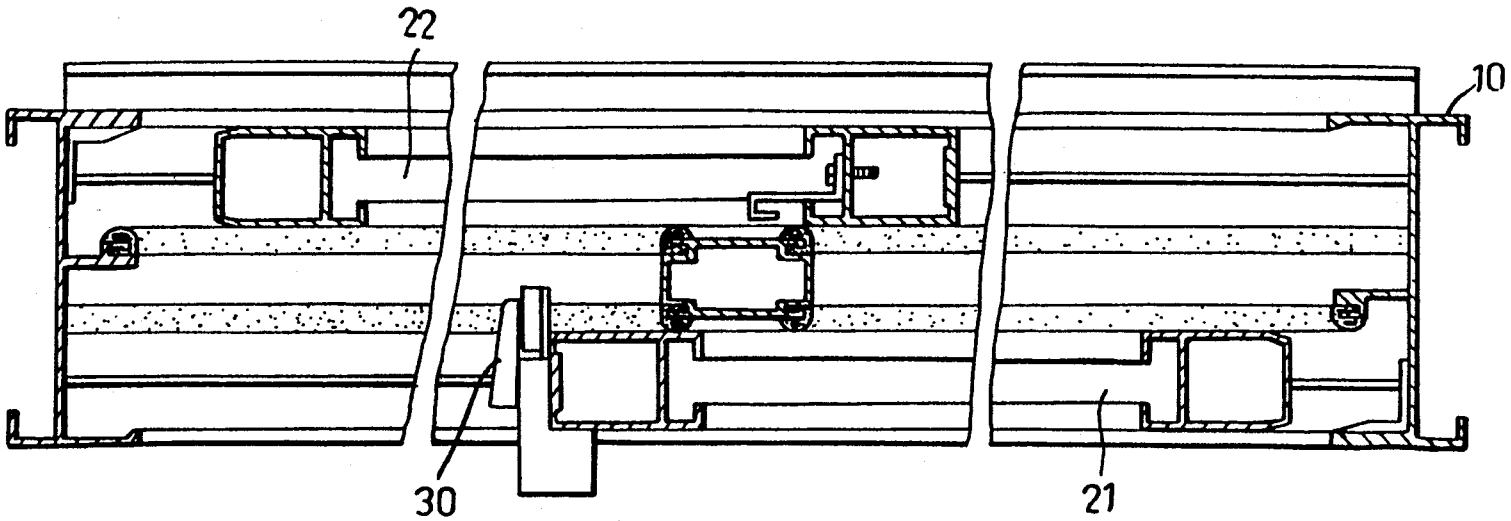
FIG. 6 is a schematic view illustrating how to lock the sliding panels in the window structure in accordance with this invention.

Referring to FIG. 6, when the sliding panels (21, 22) are moved to the closed positions and are interlocked by the locking element (30), a liquid- and air-tight seal is established between the frame (10) and the sliding panels (21, 22) with the assistance of the guiding members (C3).

With this invention thus explained, it is apparent that numerous modifications and variations can be made without departing from the scope and spirit of this invention. It is therefore intended that this invention be limited only as indicated in the appended claims.

I claim:

1. A window structure including a frame, an inner sliding panel disposed movably in the frame, an outer sliding panel disposed movably in the frame outside said inner sliding panel, and a locking element interlocking the sliding panels so as to close the window structure, the frame consisting of two horizontal members and two vertical members, each of the horizontal members having two parallel channels formed therein along which the inner and outer sliding panels are slidable between a closed position and an open position, the improvement comprising:

the frame including a middle pillar which interconnects middle portions of said horizontal members, said middle pillar having an inner surface, an outer surface and a pair of opposing side surfaces;

each of said horizontal members including a horizontal dividing rib projecting therefrom in alignment with said middle pillar, said horizontal dividing ribs extending toward each other;

each of said vertical members including a vertical dividing rib projecting from a middle portion thereof which is aligned with said middle pillar, said vertical dividing ribs extending toward each other, said inner and outer sliding panels being positioned on two sides of said horizontal and vertical dividing ribs; and, said frame having an endless inner slot and an endless outer slot which are formed therein, said endless inner slot extending along a rectangular path in a first plane and formed in one of said vertical dividing ribs, one of said side surfaces of said middle pillar and said horizontal dividing ribs between one of said vertical members and said middle pillar, said endless inner slot being filled with a resilient inner primary sealing strip which establishes a liquid- and air-tight seal between said inner sliding panel and said frame when said inner sliding panel is in the closed position, said endless outer slot extending along a rectangular path in a second plane and formed in the other of said vertical dividing ribs, the other of said side surfaces of said middle pillar and said horizontal dividing ribs between the other of said vertical members and said middle pillar, said endless outer slot being filled with a resilient outer primary sealing strip which establishes a liquid- and air-tight seal between said outer sliding panel and said frame when said outer sliding panel is in the closed position;

whereby, when said inner and outer sliding panels are locked in said frame by said locking element, said inner and outer sliding panels contact closely said compressible elements of said inner and outer primary sealing strips.

2. A window structure as claimed in claim 1, wherein said endless inner slot is of a cross-section having an opening and a restricting portion which is wider than said opening, said inner primary sealing strip having a generally U-shaped cross-section which includes an insertion element inserted into said restriction portion, and a compressible element positioned between said inner sliding panel and said frame, whereby, when said inner sliding panel is in the closed position, said compressible element is compressed between said inner sliding panel and said frame so as to minimize flow of liquid and air therebetween.

3. A window structure as claimed in claim 2, wherein said insertion element of said inner primary sealing strip has a truncately tapered head whereby said insertion element of said inner primary sealing strip can be easily inserted into said inner slot.

4. A window structure as claimed in claim 3, wherein said head of said insertion element is generally arrow-shaped which is confined within said restricting portion of said endless inner slot.

5. A window structure as claimed in claim 2, wherein said compressible element has a curved convex surface which can contact said inner sliding panel.

6. A window structure as claimed in claim 2, wherein said compressible element is hollow so as to be compressed by said inner sliding panel.

7. A window structure as claimed in claim 1, wherein said outer primary sealing strip has a generally U-shaped cross-section including an insertion element insertable into said endless outer slot, and a compressible element positioned between said outer sliding panel and said frame, whereby, when said outer sliding panel is in the closed position, said compressible element is compressed between said outer sliding panel and said frame so as to minimize flow of liquid and air therebetween.

8. A window structure as claimed in claim 7, wherein said insertion element of said outer primary sealing strip has a truncately tapered head whereby said insertion element of said outer primary sealing strip can be easily inserted into said endless outer slot.

9. A window structure as claimed in claim 8, wherein said head of said insertion element is generally arrow-shaped which is confined within said endless outer slot.

10. A window structure as claimed in claim 7, wherein said compressible element has a curved convex surface which can contact said outer sliding panel.

11. A window structure as claimed in claim 7, wherein said compressible element is hollow so as to be compressed by said outer sliding panel.

* * * * *